US010183505B2

(12) United States Patent
Ogasawara et al.

(10) Patent No.: US 10,183,505 B2
(45) Date of Patent: Jan. 22, 2019

(54) PRINTING APPARATUS AND PLATEN

(71) Applicant: CANON KABUSHIKI KAISHA, Tokyo (JP)

(72) Inventors: Seiji Ogasawara, Machida (JP); Tetsuji Kurata, Yokohama (JP); Masakazu Tsukuda, Yokohama (JP); Takahide Onuma, Kawasaki (JP); Yasunori Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,756

(22) Filed: May 20, 2016

(65) Prior Publication Data

US 2016/0347093 A1 Dec. 1, 2016

(30) Foreign Application Priority Data

May 27, 2015 (JP) ..... 2015-107998
Aug. 24, 2015 (JP) ..... 2015-164810

(51) Int. Cl.

| | |
|---|---|
| ***B41J 11/00*** | (2006.01) |
| ***B41J 29/17*** | (2006.01) |
| ***B41J 11/06*** | (2006.01) |
| *B41J 2/165* | (2006.01) |
| *B41J 2/17* | (2006.01) |

(52) U.S. Cl.

CPC ..... *B41J 11/0085* (2013.01); *B41J 11/0065* (2013.01); *B41J 11/06* (2013.01); *B41J 29/17* (2013.01); *B41J 2/16523* (2013.01); *B41J 2/1721* (2013.01); *B41J 2002/1742* (2013.01)

(58) Field of Classification Search

CPC ..... B41J 2/16523; B41J 2/1721; B41J 2002/1742; B41J 2002/1728

See application file for complete search history.

(56) References Cited

U.S. PATENT DOCUMENTS 5,200,767 A 4/1993 Tsukada et al.
5,389,961 A 2/1995 Takagi
(Continued)

FOREIGN PATENT DOCUMENTS

CN 1700992 A 11/2005
CN 1907715 A 2/2007
(Continued)

OTHER PUBLICATIONS

Machine Translation of Nov. 20, 2018 IDS—NPL #1—Retrieved using the AIPN system by STIC Translations. Nov. 26, 2018. (Year: 2018).*

(Continued)

*Primary Examiner* — John P Zimmermann
(74) *Attorney, Agent, or Firm* — Venable LLP

(57) ABSTRACT

A printing apparatus includes a suction unit configured to allow a negative pressure, by which a sheet is sucked to a supporting portion, to act on the sheet; and ink receivers configured to receive ink ejected outside of the sheet. Waste ink ejected to the ink receivers is guided to a waste ink discharge port formed on an outer peripheral wall of a platen through waste ink channels. A sheet sucking mechanism configured to apply the negative pressure is disposed adjacent to the suction unit. A discharging mechanism configured to forcibly discharge waste ink outside of the platen is connected to the waste ink discharge port.

16 Claims, 20 Drawing Sheets

(56) References Cited

U.S. PATENT DOCUMENTS

| | | | | |
|---|---|---|---|---|
| 5,398,049 | A | 3/1995 | Terasawa et al. | |
| 5,570,116 | A | 10/1996 | Soga | |
| 5,717,446 | A | 2/1998 | Teumer et al. | |
| 5,847,736 | A * | 12/1998 | Kanbayashi | B41J 2/1652 347/33 |
| 5,880,754 | A | 3/1999 | Niikura et al. | |
| 6,039,432 | A * | 3/2000 | Fukuoka | B41J 2/16508 347/30 |
| 6,168,259 | B1 * | 1/2001 | Capurso | B41J 2/04 347/36 |
| 6,471,315 | B1 | 10/2002 | Kurata | |
| 6,886,909 | B2 | 5/2005 | Ogasawara | |
| 6,899,411 | B2 | 5/2005 | Niikura et al. | |
| 7,284,814 | B2 | 10/2007 | Ogasawara | |
| 7,571,981 | B2 | 8/2009 | Yamada | |
| 8,336,985 | B2 | 12/2012 | Hokazono et al. | |
| 8,419,155 | B2 | 4/2013 | Kawakami et al. | |
| 8,469,486 | B2 | 6/2013 | Sutton et al. | |
| 8,950,844 | B2 | 2/2015 | Takahashi et al. | |
| 9,090,099 | B2 | 7/2015 | Ogasawara | |
| 9,340,027 | B2 | 5/2016 | Ogasawara | |
| 2003/0151639 | A1 * | 8/2003 | Takahashi | B41J 2/1714 347/36 |
| 2005/0062794 | A1 * | 3/2005 | Kanamitsu | B41J 2/16523 347/31 |
| 2005/0122375 | A1 | 6/2005 | Otsuki | |
| 2005/0200650 | A1 | 9/2005 | Inokuchi et al. | |
| 2006/0132513 | A1 | 6/2006 | Ozaki et al. | |
| 2007/0046757 | A1 * | 3/2007 | Kim | B41J 11/06 347/104 |
| 2007/0097171 | A1 | 5/2007 | Kagami et al. | |
| 2007/0126832 | A1 | 6/2007 | Kito | |
| 2009/0021556 | A1 | 1/2009 | Zhao et al. | |
| 2010/0171788 | A1 * | 7/2010 | Heo | B41J 2/16532 347/30 |
| 2013/0100202 | A1 * | 4/2013 | Ogasawara | B41J 2/16526 347/31 |
| 2016/0288505 | A1 | 10/2016 | Tsukuda et al. | |
| 2017/0368830 | A1 * | 12/2017 | Nakagawa | B41J 2/16517 |

FOREIGN PATENT DOCUMENTS

| | | | |
|---|---|---|---|
| JP | 2001-219533 | A | 8/2001 |
| JP | 2002-086821 | A | 3/2002 |
| JP | 2002-225311 | A | 8/2002 |
| JP | 2004-155107 | A | 6/2004 |
| JP | 2005-125612 | A | 5/2005 |
| JP | 2006-187903 | | 7/2006 |
| JP | 2006-248026 | A | 9/2006 |
| JP | 2006-326957 | A | 12/2006 |
| JP | 2007-320250 | A | 12/2007 |
| JP | 2010-194917 | A | 9/2010 |
| JP | 2011-046145 | A | 3/2011 |
| JP | 2013-086423 | A | 5/2013 |

OTHER PUBLICATIONS

Office Action dated Mar. 7, 2017 in U.S. Appl. No. 15/160,532.
Office Action dated May 9, 2018 in Chinese Patent Application No. 201610364331.2.
U.S. Appl. No. 15/160,382, filed May 20, 2016.
U.S. Appl. No. 15/160,532, filed May 20, 2016.
U.S. Appl. No. 15/160,574, filed May 20, 2016.
Office Action dated Oct. 2, 2018, in Japanese Patent Application No. 2015-164810.

* cited by examiner

PRINTING APPARATUS AND PLATEN

BACKGROUND OF THE INVENTION

Field of the Invention

The present invention relates to an inkjet printing apparatus provided with a platen for supporting a sheet.

Description of the Related Art

An inkjet printing apparatus disclosed in Japanese Patent Laid-Open No. 2006-187903 uses a suction platen that sucks a sheet by a negative pressure. Furthermore, a duct and a waste ink tank are disposed under the platen so as to recover ink (waste ink) discarded during marginless printing.

The inkjet printing apparatus disclosed in Japanese Patent Laid-Open No. 2006-187903 is configured such that a guide channel extending from the platen to the waste ink tank is formed sideways of the duct, that is, is flush with the duct. Therefore, the capacity of the duct must be reduced, whereby negative pressure control by a negative pressure generating fan is liable to become unstable. In addition, the arrangement of the waste ink tank also is limited. Consequently, the large size of the entire apparatus is inevitable in achieving the compatibility between waste ink recovery and sheet suction.

SUMMARY OF THE INVENTION

An object of the present invention is to provide a printing apparatus capable of securely performing marginless printing while suppressing floating or flexure of a sheet owing to the suction of the sheet, and furthermore, capable of securely achieving the compatibility between waste ink recovery and sheet suction without increasing the size of the apparatus, and a platen.

According to one aspect of the present invention that can achieve the above-described object, a printing apparatus is provided with a printhead configured to eject ink and a platen configured to support a sheet in a manner facing the printhead. The platen includes: at least one supporting portion configured to support a sheet; an ink receiver configured to receive ink ejected by the printhead to the outside of the sheet supported by the supporting portion; and a waste ink channel configured to guide waste ink ejected to the ink receiver to a discharge port formed on the outer peripheral wall of the platen. A discharging mechanism configured to discharge the waste ink is connected to the discharge port.

According to the present invention, it is possible to securely perform marginless printing while suppressing floating or flexure of a sheet owing to the suction of the sheet, and furthermore, to securely achieve the compatibility between waste ink recovery and sheet suction without increasing the size of the apparatus.

Further features of the present invention will become apparent from the following description of exemplary embodiments (with reference to the attached drawings).

DESCRIPTION OF THE EMBODIMENTS

A description will be given below of an embodiment of a printing apparatus according to the present invention. Hereinafter, the present invention will be described by way of an inkjet printing apparatus of a serial type for performing printing by reciprocating a printhead in a direction transverse to a sheet conveyance direction, the printhead being capable of ejecting ink on a sheet that is intermittently conveyed in a predetermined direction. The present invention is applicable to not only a printing apparatus of a serial type but also a line printing apparatus for sequentially performing printing by the use of an elongated printhead. Moreover, the printing apparatus is applicable to not only a printing apparatus having a single function but also a multiple function printer equipped with a copying function, a facsimile function, and the like.

1. Outline of Apparatus

Figure 1:
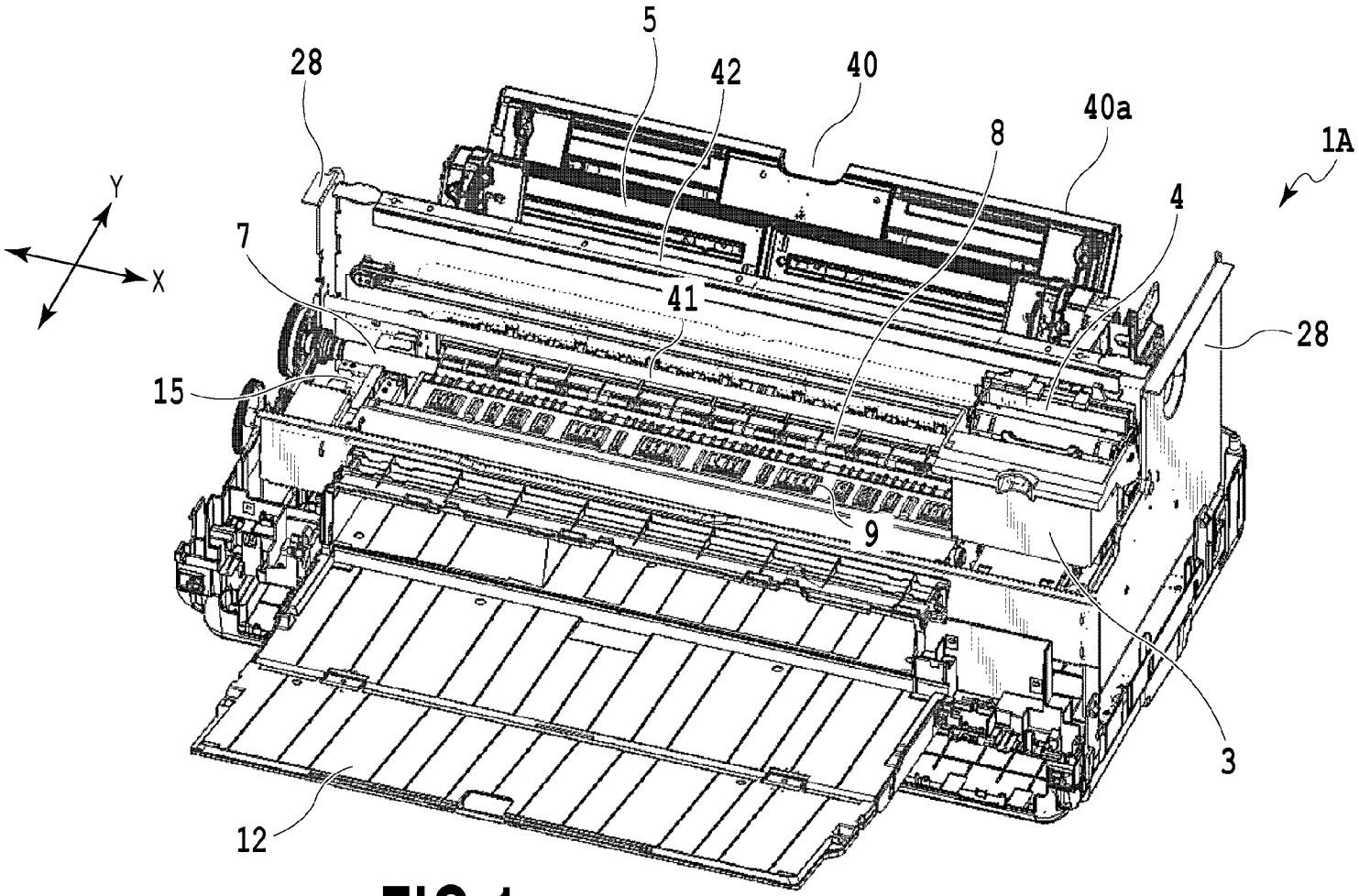
FIG. 1 is a perspective view showing the entire configuration of a printing apparatus body.

A description will be given of a printing apparatus 1 in the present embodiment. FIG. 1 is a perspective view showing the entire configuration of the printing apparatus 1, from which an exterior member is detached; and FIG. 2 is a vertical side view showing the printing apparatus 1 shown in FIG. 1.

Figure 2:
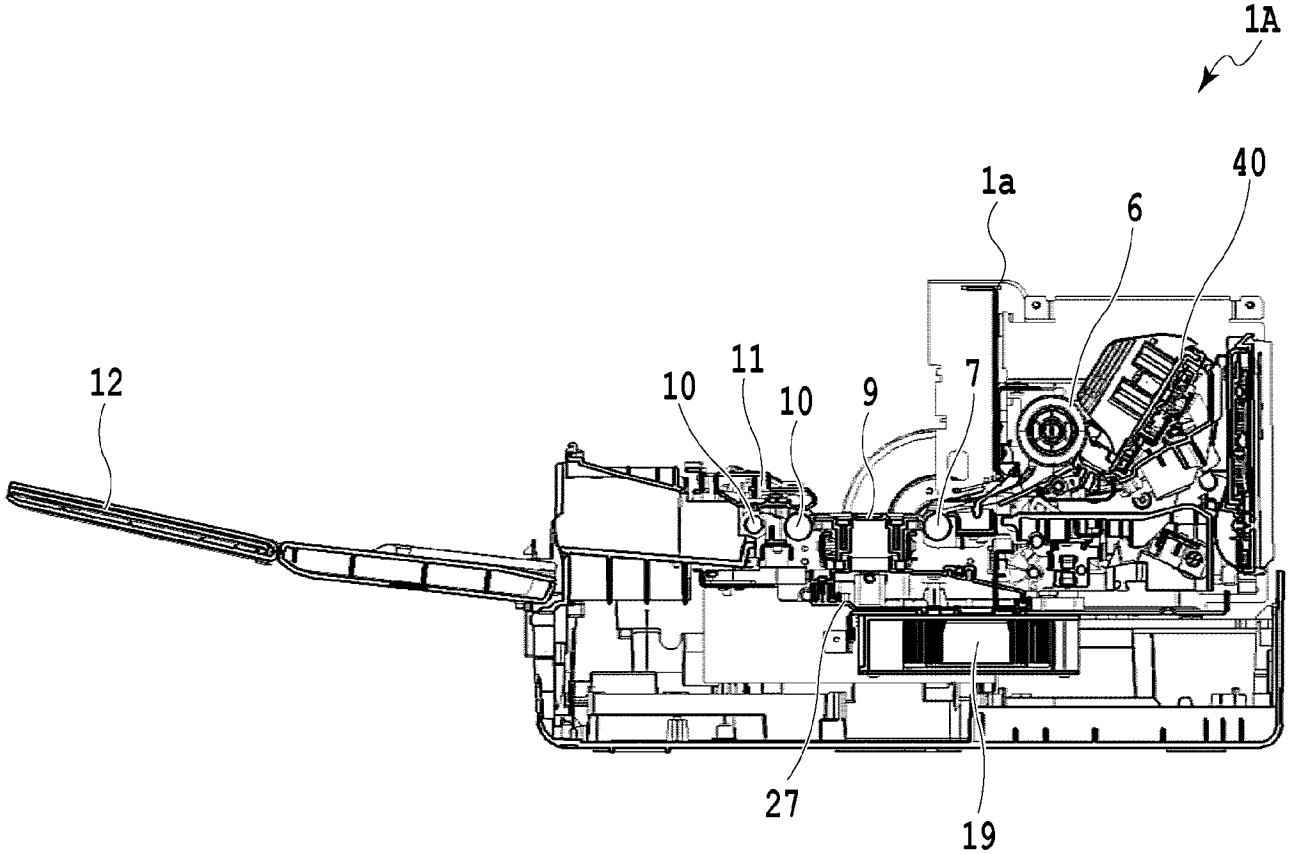
FIG. 2 is a vertical side view showing a printing apparatus.

In FIGS. 1 and 2, a feeder 40 is disposed at the back of the printing apparatus 1. The feeder 40 separates a bundle of cut sheets (hereinafter simply referred to as sheets) stacked on a feed tray 40*a* one by one according to the rotation of a feed roller 6, and then, feeds them to a conveyor such as a conveyance roller 7. In addition, a carriage 4 mounting thereon a printhead 3 capable of ejecting ink is disposed in the printing apparatus 1. The carriage 4 is supported in a freely reciprocating manner along a carriage guide shaft 41 and a carriage rail 42 disposed in a direction (i.e., an X direction) transverse (perpendicularly in the embodiment) to a sheet conveyance direction (i.e., a Y direction). The movement of the carriage 4 and the printhead 3 in the X direction will also be referred to as scanning in the following description. The X direction represents the carriage movement direction, and furthermore, is a sheet widthwise direction of the sheet to be conveyed. The Y direction represents the sheet conveyance direction.

One sheet separated from the bundle of sheets stacked on the feed tray 40*a* and fed by the feeder 40 is conveyed onto a platen 9 that supports the sheet in a manner facing the printhead 3 by a first conveyance roller pair (i.e., the conveyor) consisting of the conveyance roller 7 and a pinch roller 8. Here, the carriage 4 mounting the printhead 3 thereon is moved in the X direction, and then, ink is ejected toward the sheet from the printhead 3. A sheet detecting sensor that detects the end of the sheet is disposed at one side surface of the carriage 4. The relative position between the sheet and the printhead 3 and a print starting timing with respect to the sheet are determined based on a detection output from the sheet detecting sensor.

Upon completion of printing of one scanning on the sheet, the sheet is conveyed by a predetermined distance in the Y direction by the first conveyance roller pair. The repetition of the scanning of the printhead 3 and the conveyance of the sheet achieves serial printing on the sheet in a serial printing system.

A printed sheet is discharged onto a discharge tray 12 by a second conveyance roller pair (i.e., a conveyor) consisting of discharge rollers 10 and a pulley disposed downstream of the platen 9 in the sheet conveyance direction (i.e., the Y direction). Incidentally, the above-described feeder 40, carriage guide shaft 41, carriage rail 42, and platen 9 are securely supported by a chassis 28 that forms the frame of the printing apparatus 1.

2. Platen

Figure 3:
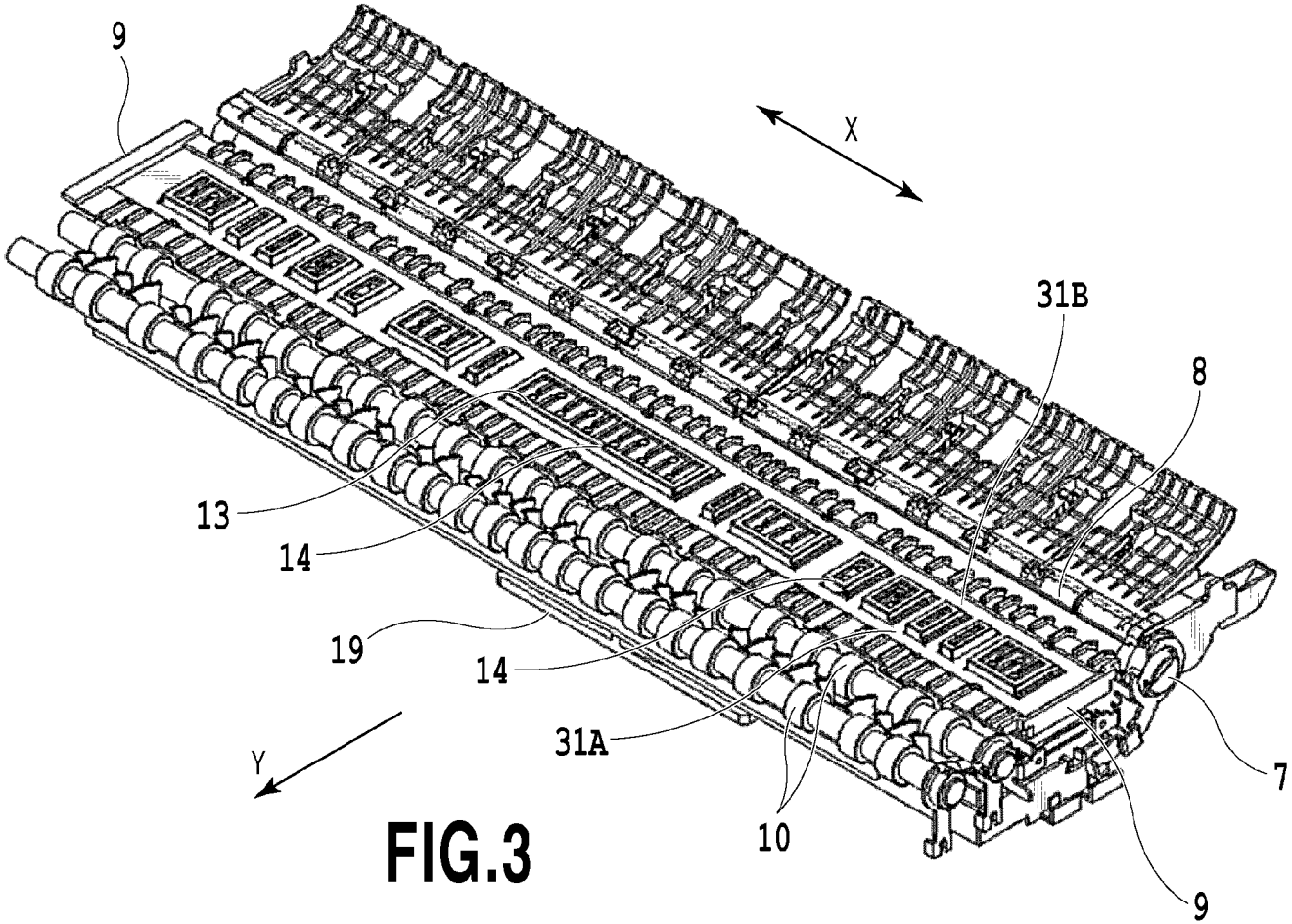
FIG. 3 is a perspective view showing a platen and its peripheral structure.

Next, explanation will be made on the structure of the platen 9 for use in the printing apparatus. FIG. 3 is a perspective view showing the platen 9 and its peripheral structure. As shown in FIG. 3, the platen 9 is interposed between the first conveyance roller pair consisting of the conveyance roller 7 and the pinch roller 8 and the second conveyance roller pair consisting of the discharge rollers 10 and the pulley 11. The platen 9 supports the sheet to be conveyed by the first and second conveyance roller pairs on a side (i.e., a reverse) opposite to a side to be printed.

2.1 Sheet Supporting Portion

Figure 4:
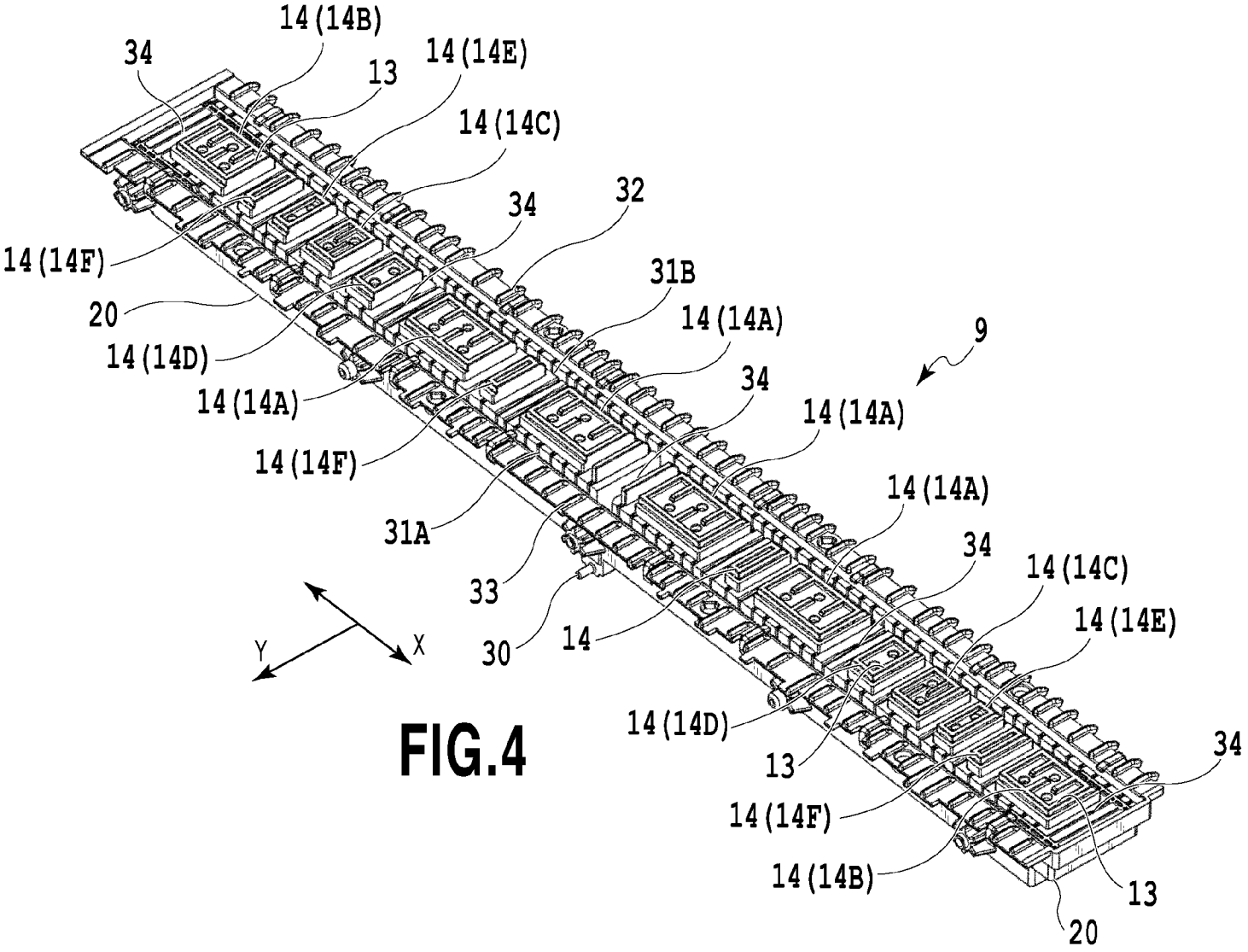
FIG. 4 is a perspective view showing the entire configuration of the platen.

FIG. 4 is a perspective view showing the entire configuration of the platen 9. The platen 9 is provided with a sheet supporting portion (i.e., a support unit) 14 capable of supporting the reverse of the sheet while suppressing floating or flexure of the sheet in order to properly keep an interval between an ejection port face 3*a* of the printhead 3 and the sheet. The plurality of sheet supporting portions 14 are formed in the longitudinal direction (i.e., the X direction) of the platen 9.

Figure 5:
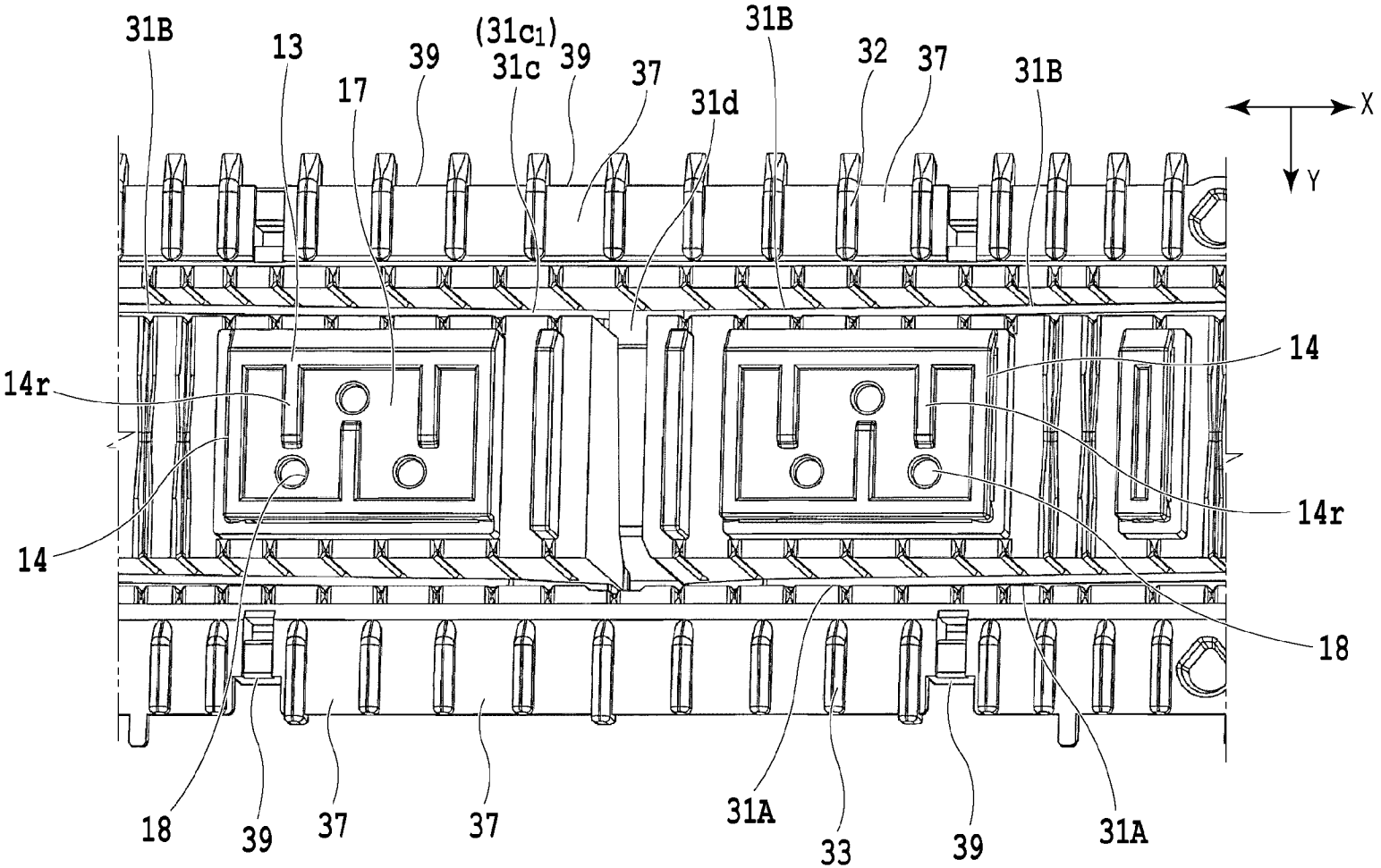
FIG. 5 is an enlarged view partly showing the platen.

FIG. 5 is an enlarged view partly showing the platen 9 shown in FIG. 4. The sheet supporting portion 14 is formed into a rectangular frame with a projecting portion. A sheet supporting surface 13 of the supporting portion 14 has a width of about several millimeters. Moreover, a suction recess 17 is formed at the upper portion of the sheet supporting portion 14, thereby forming a recess lower by one step than the sheet supporting surface 13. Suction holes (i.e., suction units) 18 are formed at the bottom surface of the suction recess 17 in such a manner as to penetrate the platen 9. The suction holes 18 communicate with a negative pressure generator 19, described later. A negative pressure generated by the negative pressure generator 19 is supplied to the suction recess 17 through the suction holes 18. The sheet passing the sheet supporting surface 13 is sucked by the negative pressure supplied to the suction recess 17, and then, is sucked to the sheet supporting surface 13. In this manner, the sheet 2 is conveyed while being kept flat without any flexure or floating. Consequently, a distance (i.e., a distance to a sheet) between a surface, at which an ejection port is formed, of the printhead 3 and the sheet is kept at a preset proper distance.

Figure 7:
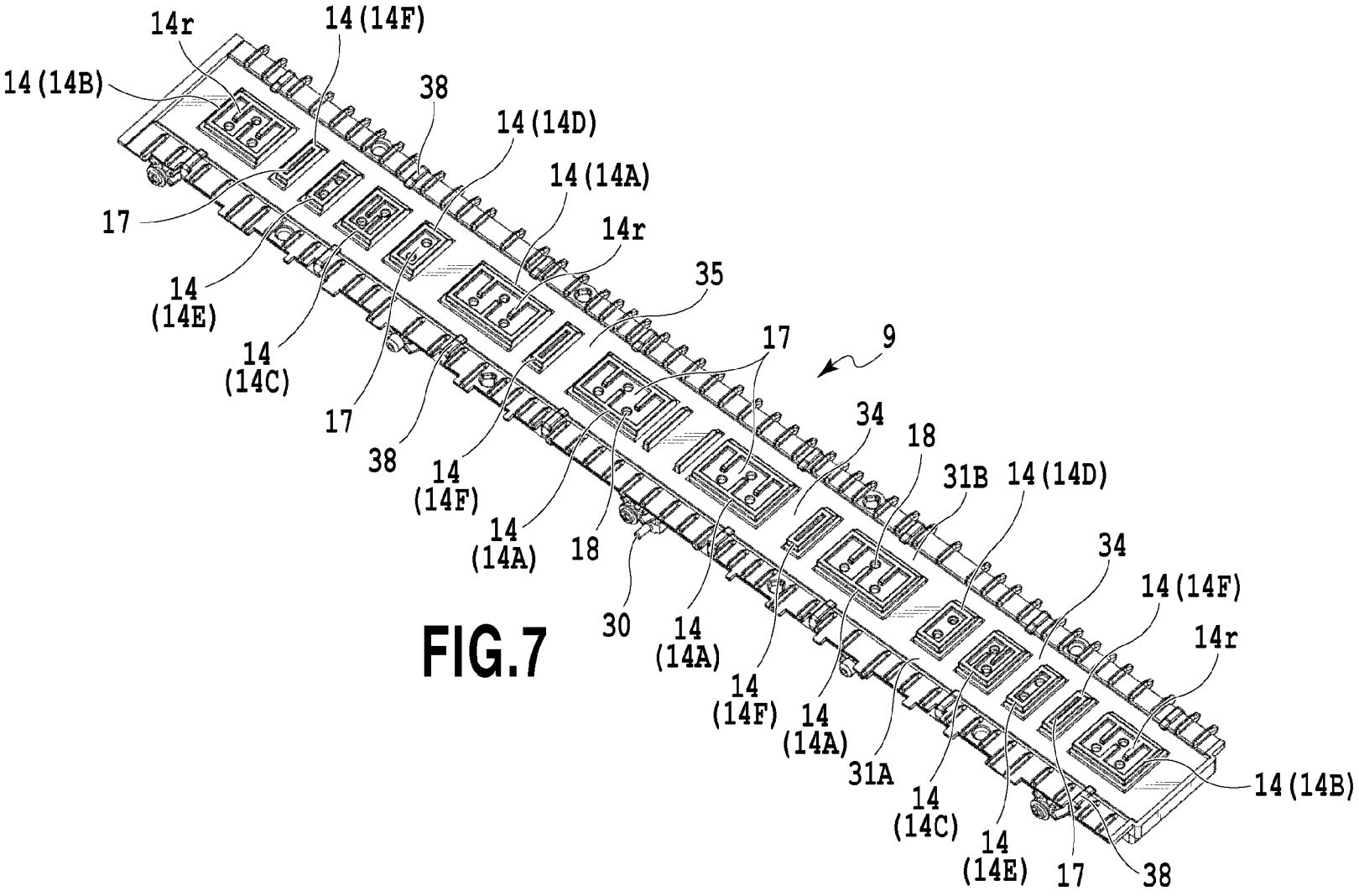
FIG. 7 is a perspective view showing a state in which an ink absorber is disposed in an ink discarding groove.

Six kinds of sheet supporting portions 14 (first to sixth sheet supporting portions (14A to 14F)) having different sizes are formed to cope with a plurality of kinds of sheets having different sheet widths (i.e., sizes of sheets in the X direction) (see FIGS. 4 and 7). Among these sheet supporting portions 14, each of the first sheet supporting portion 14A to the fifth sheet supporting portion 14E has the suction recess 17 having a relatively large area, and therefore, the suction holes 18 are formed thereat. However, the area of the suction recess 17 is small at the smallest sixth sheet supporting portion 14F, and therefore, no suction hole 18 is formed. In the present embodiment, the sheet supporting portion 14F copes with a sheet of a 2L size and a sheet of an HP size, and no suction hole is formed at the suction recess 17 of each of the sheet supporting portions 14F.

At the first, second, and third sheet supporting portions 14A, 14B, and 14C that are formed into a relatively large frame, intermediate ribs 14*r*, each having the same height as that of the sheet supporting surface 13, are formed in the direction perpendicular to the X direction (i.e., the Y direction) in such a manner as to prevent the sheet from denting at the suction recess 17. Here, three intermediate ribs 14*r* are formed at each of the first sheet supporting portion 14A and the second sheet supporting portion 14B; and two intermediate ribs 14*r* are formed at the third sheet supporting portion 14C. Here, the upper surface of the intermediate rib 14*r* has a support surface flush with the sheet supporting surface 13 formed into a frame. The fourth to sixth sheet supporting portions 14D to 14F have no intermediate rib 14*r*. It is desirable that the number of suction holes 18, the diameter of the suction hole 18, the number of intermediate ribs 14*r*, and the like should be appropriately determined according to the sizes of the sheet supporting portion 14 and the suction recess 17 that are determined according to the corresponding sheet sizes.

Upstream sheet supporting portions 32 for supporting the sheet conveyed by the conveyance roller 7 at the reverse thereof are formed at the platen 9 further upstream of a trailing end ink discarding groove 31B, described later, formed at the platen 9. In addition, downstream sheet supporting portions 33 for supporting the sheet conveyed by the discharge rollers 10 at the reverse thereof are formed at the platen 9 further downstream of a leading end ink discarding groove 31A, described later, formed at the platen 9. The upstream sheet supporting portions 32 and the downstream sheet supporting portions 33 each are ribbed projections extending in the sheet conveyance direction (i.e., the Y direction). The plurality of upstream sheet supporting portions 32 and the plurality of downstream sheet supporting portions 33 are arranged at constant intervals in the X direction, as shown in FIG. 5.

The top of each of the upstream sheet supporting portions 32 and the downstream sheet supporting portions 33 is formed in the same height as that of the sheet supporting surface (i.e., a contact portion) 13 of the sheet supporting portion 14. The upstream sheet supporting portions 32 and the downstream sheet supporting portions 33 fulfill the function of preventing the sheet from denting at the sheet supporting portion 14 or being involved in either of the rollers in a case where the leading or trailing end of the sheet passes the sheet supporting portion 14 and the rollers.

2.2 Ink Discarding Unit

In order to securely print the entire sheet without any margins at the peripheral edges of the sheet, that is, securely perform so-called marginless printing, it is necessary to eject ink up to the outside of the ends of the sheet. Moreover, in the printing apparatus of the inkjet system, ink is ejected to the outside of the sheet immediately before a printing operation, that is, preliminary ejection is performed in order to stabilize ink ejection performance of the printhead 3. The ink ejected to the outside of the sheet in this manner is received in ink receivers formed at the platen 9. The ink receivers in this embodiment include the leading end ink discarding groove (i.e., a first ink receiver) 31A for receiving ink ejected to the outside of the sheet leading end and the trailing end ink discarding groove (i.e., a second ink receiver) 31B for receiving ink ejected to the outside of the sheet trailing end. Moreover, in the present embodiment, the ink receivers include right/left end ink discarding grooves 34 (i.e., third ink receivers), so as to receive ink ejected to the outside of right and left ends (i.e., sheet side ends) in the sheet widthwise direction.

Figure 6:
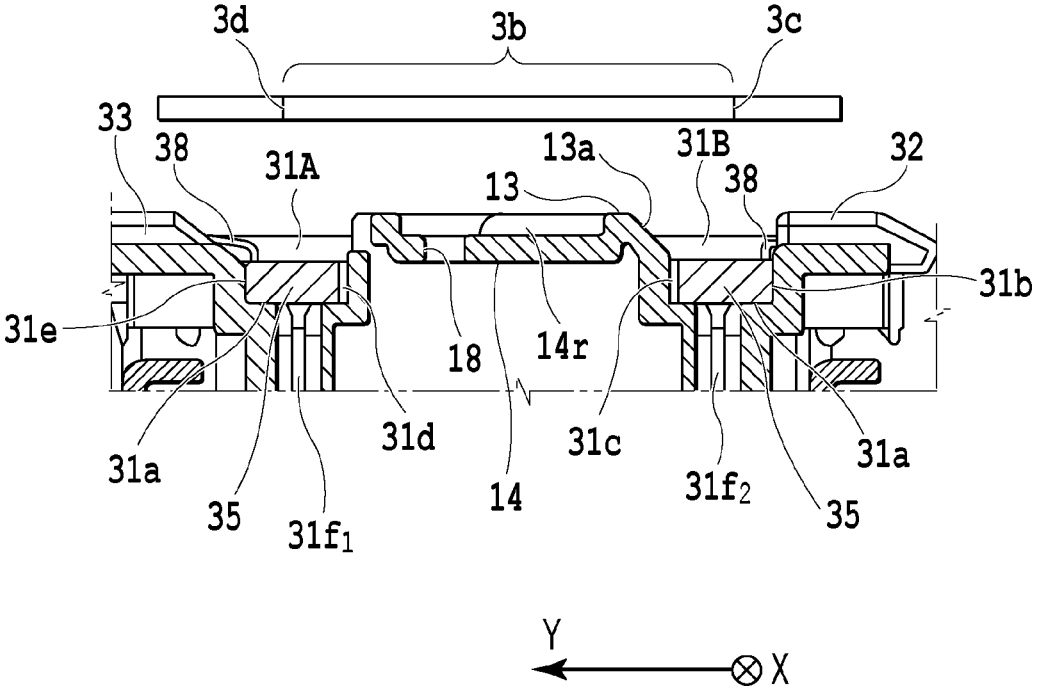
FIG. 6 is a vertical side view partly showing the platen.

FIG. 6 is a vertical side view partly showing the platen 9. FIG. 6 shows the cross sections of the leading end ink discarding groove 31A and trailing end ink discarding groove 31B of the platen 9. As shown in FIG. 6, the leading end ink discarding groove 31A is elongated in the X direction adjacently downstream of the sheet supporting portion 14 whereas the trailing end ink discarding groove 31B is elongated in the X direction adjacently upstream of the sheet supporting portion 14. The leading end ink discarding groove 31A includes a bottom 31*a* lower than the sheet supporting surface 13, a downstream wall 31*d* of the sheet supporting portion 14, and a side wall 31*e* of the downstream sheet supporting portion 33. In contrast, the trailing end ink discarding groove 31B includes a bottom 31*a* lower than the sheet supporting surface 13, an upstream wall 31*c* of the sheet supporting portion 14, and a side wall 31*b* of the upstream sheet supporting portion 32. The leading end ink discarding groove 31A and the trailing end ink discarding groove 31B have a capacity enough to prevent the ink from overflowing in a case where they receive the ink ejected from the printhead 3.

In the meantime, in order to securely perform the marginless printing at the right and left ends (i.e., sheet side ends) of the sheet, it is necessary to eject the ink up to the outside of the right and left ends of the sheet in a case where the printhead 3 ejects the ink while performing scanning in the X direction. The right/left end ink discarding grooves 34 according to the width of each of the sheets are formed in such a manner as to receive the ink ejected to the outside of the sheet side end even in a case where the width of the sheet to be used is changed (see FIGS. 4 and 5).

The sheets that can be subjected to marginless printing have mainly standard sizes such as an L size, a 2L size, a postcard size, an A4 size, a letter size, an A3 size, a legal size, and an A2 size. In view of this, the plurality of ink discarding grooves 34 are formed at positions corresponding to the right and left ends of the sheet according to the sizes of sheets. As described above, the leading end ink discarding groove 31A, the trailing end ink discarding groove 31B, and the right/left end ink discarding grooves 34 are formed in a grid fashion at the obverse of the platen 9.

The arrangement of the sheet supporting portion 14 in the sheet width direction (i.e., the X direction) is determined with reference to a print position. In the present embodiment, the reference of the print position is set at the center of the width of a print sheet: namely, a so-called center reference sheet supply is adopted. In the case of the center reference, the sheet is conveyed such that the center of the sheet width (i.e., a print width) matches the center of the platen 9 in the widthwise direction in a case where the sheet has any one of various sheet widths. The sheet supporting portions 14 are symmetrically disposed such that the right/left end ink discarding grooves 34 are formed at symmetric positions with reference to the center position of the width of the platen 9 in the X direction. In performing the marginless printing, it is preferable that one side of the right/left end ink discarding groove 34 should be positioned inward by about 2 mm of the right or left end of the sheet whereas the other side thereof should be positioned outward by about 5 mm of the end of the sheet. As a consequence, the width of the right/left end ink discarding groove 34 and the position of the sheet supporting portion 14 are determined in such a manner as to satisfy the above-described positional relationship with respect to the various kinds of sheets having the standard sizes. Here, the positional relationships between both sides of the right/left end ink discarding groove 34 and the right and left ends of the sheet are not limited to the above-described dimensions (2 mm and 5 mm), and other dimensions may be selected, as necessary. Incidentally, other than the center reference, a one-side reference may be adopted such that all sheets having various kinds of sizes are aligned at one of right and left reference positions.

In this manner, assuming that the marginless printing is performed on four sides of a cut sheet, the sheet supporting portion 14 of the platen 9 is individually surrounded by the leading and trailing end ink discarding grooves 31A and 31B and the right/left end ink discarding grooves 34. In order to suppress the generation of mist caused by a splash at the time of landing of the ink and the overflow of the discarded ink, an ink absorber 35 is disposed at the ink discarding grooves 31A, 31B, and 34, as shown in FIGS. 6 and 7. It is preferable that the ink absorber 35 should be a spongy single sheet made of expanded urethane. The upper surface of the ink absorber 35 is locked by a plurality of lock claws 38 (see FIG. 7) serving as a plurality of lock members, so that the ink absorber 35 can be inhibited from being detached from the platen 9.

Figure 16:
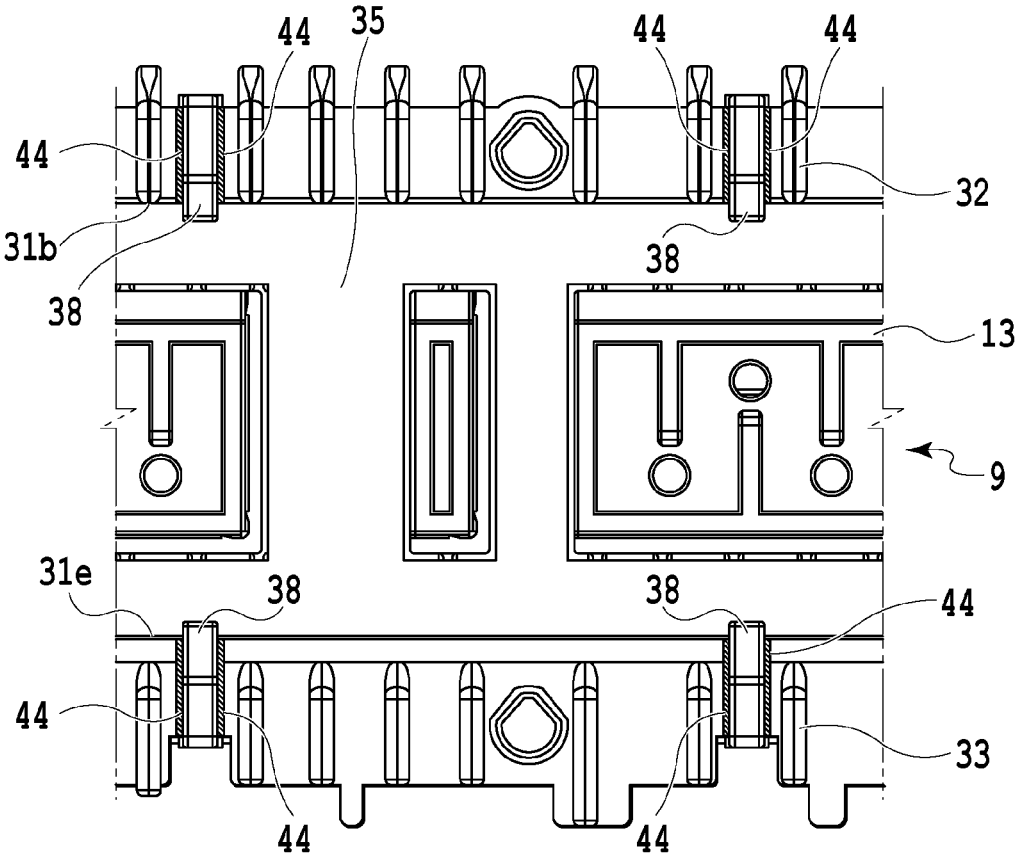
FIG. 16 is an enlarged view partly showing the platen.
Figure 17:
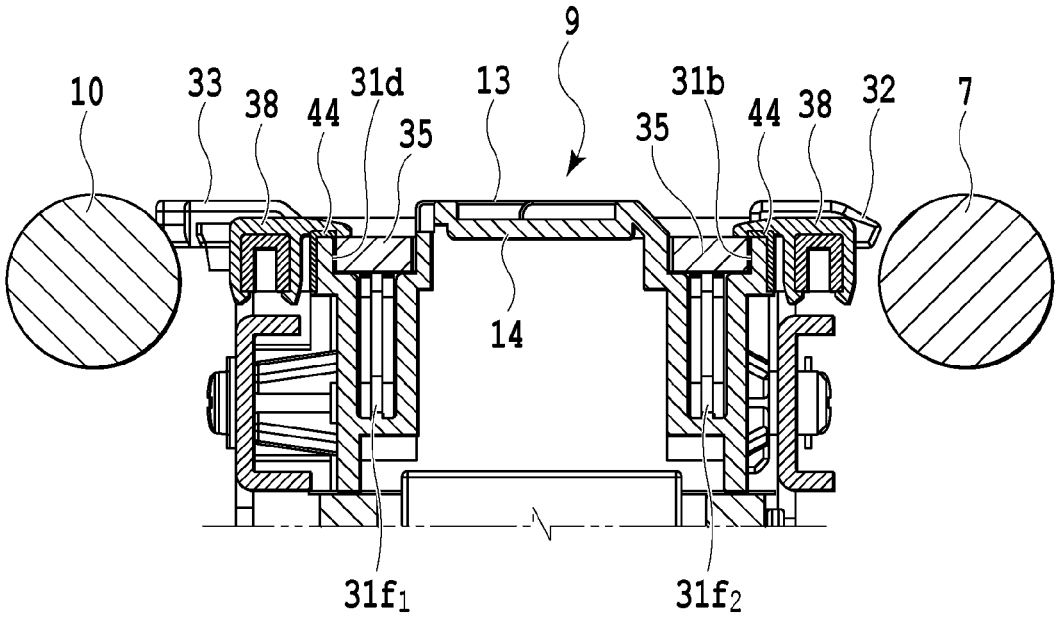
FIG. 17 is a vertical side view partly showing the platen.

Here, as shown in FIGS. 16 and 17, the ink absorber 35, the platen 9, and the lock claw 38 are disposed near each other. Therefore, ink discarded on the ink absorber 35 may leak to the outside of the platen 9 through a gap 44 defined by the plate 9 and the lock claw 38 due to a capillary phenomenon. In order to prevent the leakage, it is desirable that a gap 44 defined by the plate 9 and the lock claw 38 should be filled with a sealant or coated with a repellent such as repellent grease.

Figure 18:
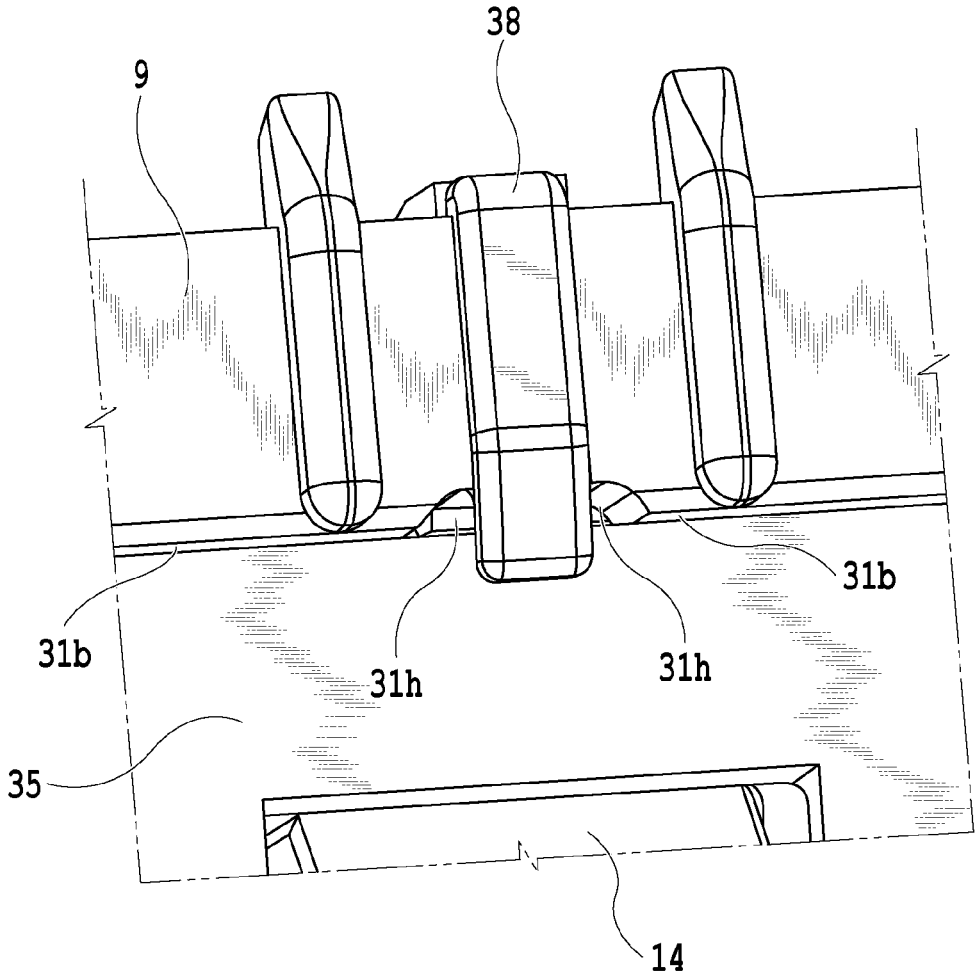
FIG. 18 is another enlarged view partly showing the platen.
Figure 19:
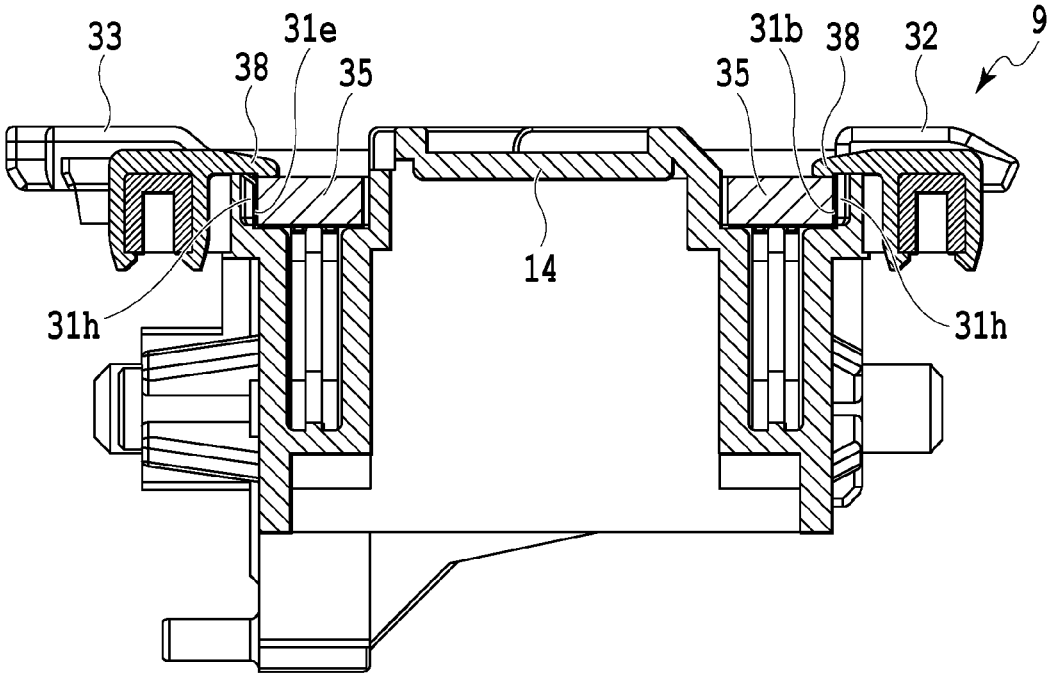
FIG. 19 is another vertical side view partly showing the platen.

Alternatively, as shown in FIGS. 18 and 19, a portion proximate to the lock claw 38 at a side wall 31*b* or 31*e* of the platen 9 is formed into a recess 31*h* that is separate from the ink absorber 35. In this manner, since the recess 31*h* is formed, the ink discarded on the ink absorber 35 cannot reach the gap 44 defined by the platen 9 and the lock claw 38, thus preventing any ink leakage to the outside of the platen 9 due to the capillary phenomenon. In addition, at the lock claw 38, a portion that does not lock the ink absorber 35 may be separated upward from the ink absorber 35 and the platen 9, thereby preventing any capillary phenomenon from occurring between the lock claw 38 and the platen 9. Here, the lock claw 38 is required to have such a height and a shape as not to inhibit sheet conveyance.

Figure 8:
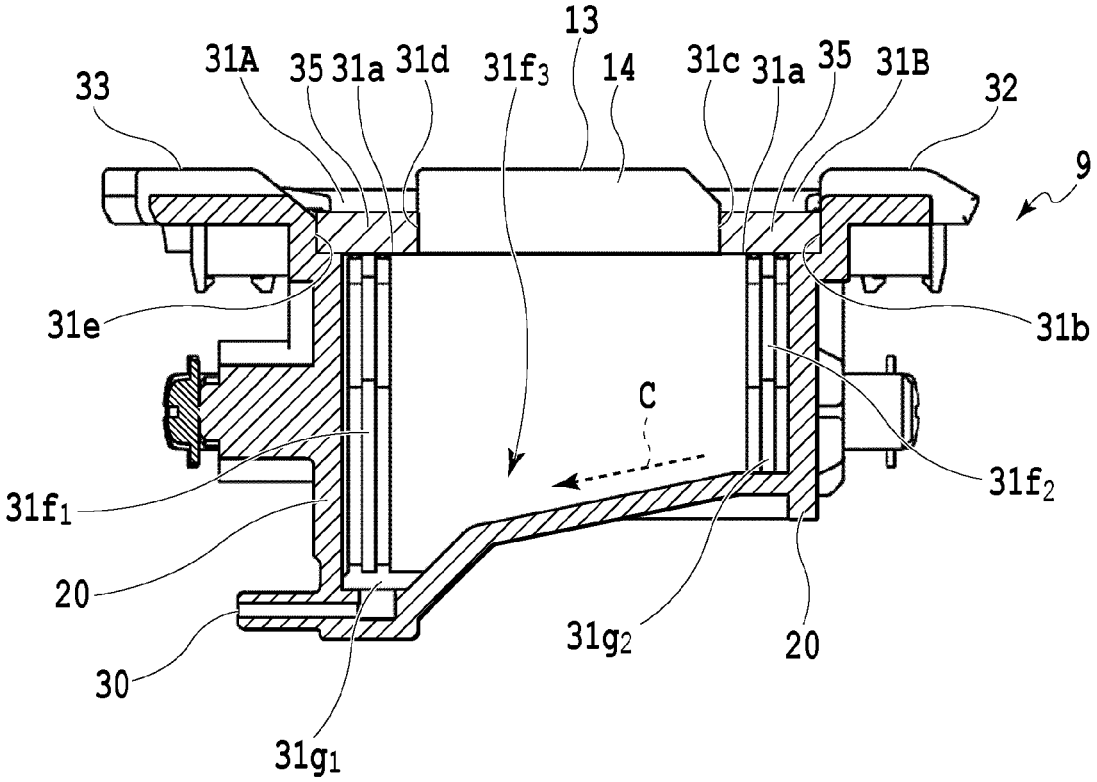
FIG. 8 is a vertical side view showing the platen.
Figure 9:
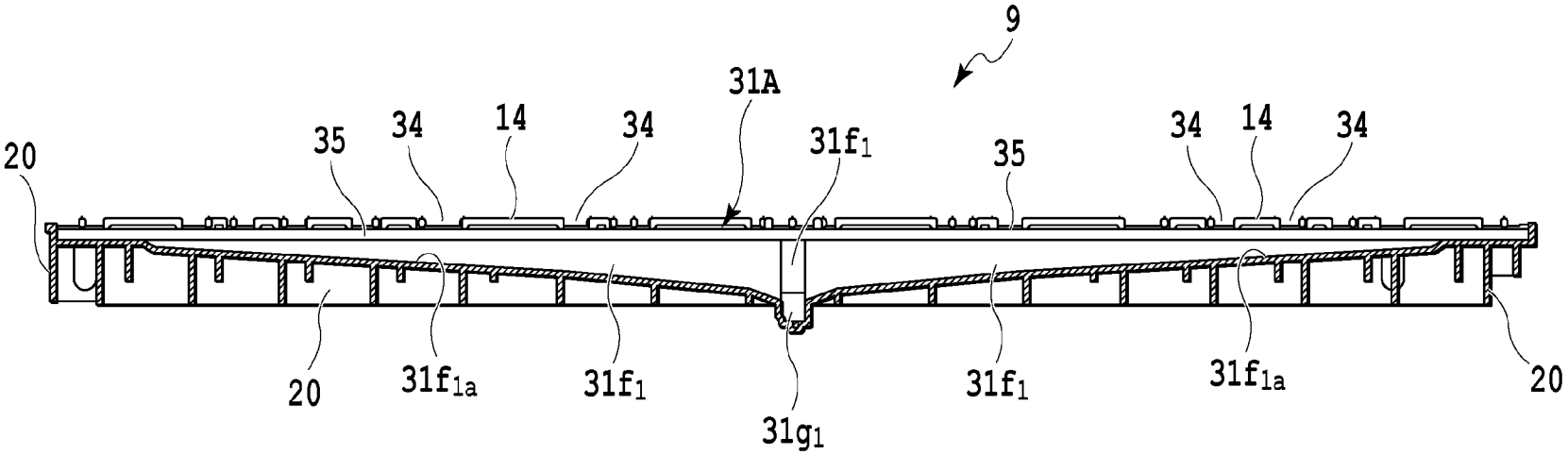
FIG. 9 is a vertical front view showing the platen.

As shown in FIG. 8, a downstream waste ink channel 31*f*1 for allowing waste ink permeating the ink absorber 35 to flow is formed at the bottom 31*a* of the leading end ink discarding groove 31A. Likewise, an upstream waste ink channel 31*f*2 for allowing waste ink permeating the ink absorber 35 to flow is formed at the bottom 31*a* of the trailing end ink discarding groove 31B. As shown in FIG. 9, a bottom 31*f*1*a* of the downstream waste ink channel 31*f*1 is inclined downward from both ends thereof to the center in the X direction. Likewise, a bottom of the upstream waste ink channel 31*f*2 is inclined downward from both ends thereof to the center in the X direction, although not particularly shown. Moreover, a downstream waste ink collector 31*g*1 is formed at the lowermost portion of the bottom of the downstream waste ink channel 31*f*1: in contrast, an upstream waste ink collector 31*g*2 is formed at the lowermost portion of the bottom of the upstream waste ink channel 31*f*2 (see FIG. 8). Here, the downstream waste ink collector 31*g*1 is formed at a position lower than the upstream waste ink collector 31*g*2.

An intermediate waste ink channel 31*f*3 is formed between the two sheet supporting portions 14A and 14B positioned at the center in the longitudinal direction (i.e., the X direction) of the platen 9. The intermediate waste ink channel 31*f*3 is adapted to connect the above-described two waste ink collectors 31*g*1 and 31*g*2 to each other. The intermediate waste ink channel 31*f*3 has a bottom inclined downward from a connection position with the upstream waste ink collector 31*g*2 toward the downstream waste ink collector 31*g*1.

With the above-described configuration, the ink discarded on the ink absorber 35 is eventually collected in the downstream waste ink collector 31*g*1. For example, the waste ink discarded in the trailing end ink discarding groove 31B is once received on the ink absorber 35, and then, the ink drops from the ink absorber 35 through the upstream waste ink channel 31*f*2. Thereafter, the waste ink is collected in the upstream waste ink collector 31*g*2. The waste ink collected in the upstream waste ink collector 31*g*2 flows along the inclined bottom of the intermediate waste ink channel 31*f*3, as indicated by a broken arrow C in FIG. 8, and eventually reaches the downstream waste ink collector 31*g*1. Furthermore, the waste ink discarded in the leading end ink discarding groove 31A and the right/left end ink discarding grooves 34 is once received on the ink absorber 35, and then, drops downward from the ink absorber 35. Finally, the waste ink is collected in the downstream waste ink collector 31*g*1.

Incidentally, elongated fine concave-convex portions are formed along an inclination at the inclined bottom (31*f*1*a*) of each of the waste ink channels 31*f*1, 31*f*2, and 31*f*3. Therefore, the flow of the waste ink toward the waste ink collectors 31*g*1 and 31*g*2 is promoted by a capillary force generated by the concave-convex portions.

The platen 9 is provided with an outer peripheral wall 20 that surrounds the sheet supporting portion 14 including the suction holes 18 and the ink discarding groove 31. The outer peripheral wall 20 forms a casing (i.e., a platen casing). At the side of the outer peripheral wall 20 is formed a waste ink discharge port 30 communicating with the downstream waste ink collector 31*g*1. The waste ink collected in the downstream waste ink collector 31*g*1 is discharged to the outside of the platen 9 through the waste ink discharge port 30.

3. Sheet Sucking Mechanism

Figure 10:
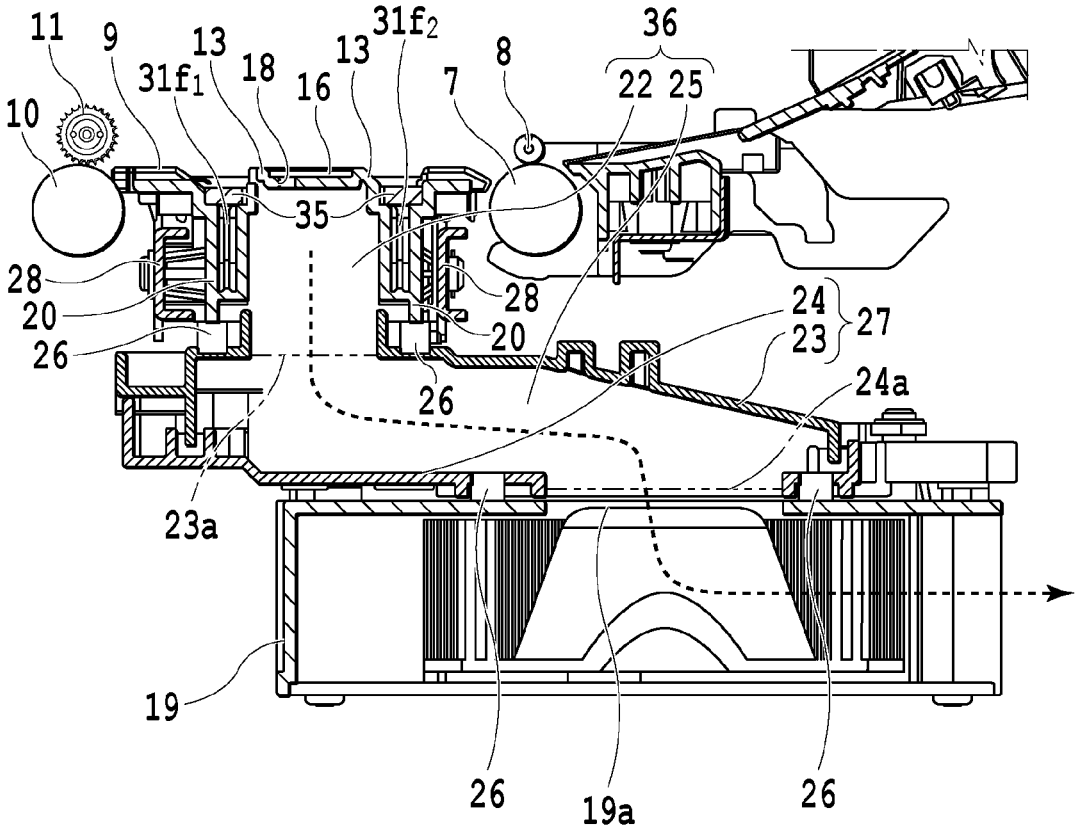
FIG. 10 is a vertical side view showing a sheet sucking mechanism.

FIG. 10 is a vertical side view showing a sheet sucking mechanism disposed in the printing apparatus 1. The sheet sucking mechanism includes the platen 9, a duct 27 communicating with the suction holes 18 formed at the platen 9, and the negative pressure generator communicating with the duct 27.

The duct 27 having a cavity therein is formed right under the platen casing formed of the outer peripheral walls 20 of the platen 9, wherein the duct 27 includes a cover member 23 having a first opening 23*a* formed at the upper surface thereof and a base member 24 having a second opening 24*a* formed at the lower surface thereof. The upper portion of the cover member 23 engages with the bottom of the outer peripheral wall 20 of the platen 9 in such a manner as to include the first opening 23*a*. In contrast, the second opening 24*a* formed at the lower surface of the base member 24 engages with a suction port 19*a* of a suction fan 19 serving as the negative pressure generator. In this manner, an intake channel 36 is formed from the suction holes 18 formed at the platen 9 to the suction fan 19.

The intake channel 36 includes a first negative pressure chamber 22 corresponding to a space inside of the platen casing defined by the outer peripheral walls 20 of the platen 9 and a second negative pressure chamber 25 formed inside of the duct 27 including the base member 24 and the cover member 23. Here, the base member 24 forming the duct 27 is fixed to the chassis 28.

The first negative pressure chamber 22 is divided into a plurality of small spaces independent of each other in the sheet widthwise direction in a manner corresponding to the plurality of sheet supporting portions 14. FIG. 10 shows one small space. The first negative pressure chamber 22 and the second negative pressure chamber 25 are partitioned by the cover member 23. The common second negative pressure chamber 25 communicates with the plurality of first negative pressure chambers 22 via the openings 23*a* of the small spaces.

Here, the downstream waste ink channel 31*f*1 and the upstream waste ink channel 31*f*2 are adjacently disposed downstream and upstream of the second negative pressure chamber 22, respectively. In this manner, it is possible to achieve the compact and highly integrated platen without any useless space arrangement.

A seal member 26 for preventing any leakage of air is disposed at each of an engagement portion between the upper surface of the cover member 23 and the bottom of the outer peripheral wall 20 of the platen 9 and an engagement portion between the second opening 24*a* of the base member 24 and the suction port 19*a* of the suction fan 19. It is preferable that the seal member 26 should be formed of soft expanded rubber or the like that has high sealability and is made of EPDM such that the platen 9 or the cover member 23 cannot be deformed by the repulsive force of the seal member 26 at the time of compression. The seal member 26 is interposed between members, thus suppressing the transmission of vibrations caused by driving the suction fan 19 to the platen 9 while keeping the sealability between the members so as to suppress an adverse effect on the printing operation.

The waste ink discharge port 30 at the platen 9 is disposed on the outer peripheral wall 20 of the platen 9 in such a manner as to discharge the waste ink sideways. Therefore, the duct 27 disposed right under the platen 9 can occupy the space right under the platen 9 without any inhibition of the arrangement of the waste ink discharge port 30. Consequently, the second negative pressure chamber 25 of the duct 27 can secure a size enough to stabilize the negative pressure generated by the rotation of the suction fan 19, thereby remarkably enhancing the freedom degree of a design.

It is preferable that the suction fan 19 serving as the negative pressure generator should be a sirocco fan or the like having an excellent suction efficiency. The suction air rate of the suction fan 19 can be adjusted under a PWM control. The air rate is variable according to the type of sheet, the state of a sheet, and use atmospheric environment, thereby adjusting the suction of the sheet.

With the above-described configuration, the suction fan 19 is rotated to discharge the air in the duct 27, thus bringing the entire intake channel 36 into a negative pressure state, so as to suck the air through the suction holes 18 communicating with the duct 27.

Incidentally, the platen 9 is molded with a resin into a single component part. All of the plurality of sheet supporting portions 14, upstream sheet supporting portions 32, downstream sheet supporting portions 33, first negative pressure chambers 22, ink receivers, and waste ink channels are aggregated into a single resin-molded component part that forms the platen 9. In this manner, it is possible to simplify the fabrication of the printing apparatus 1, and furthermore, enhance the accuracy of relative positions among functional component parts.

4. Waste Ink Discharging Mechanism

Figure 11:
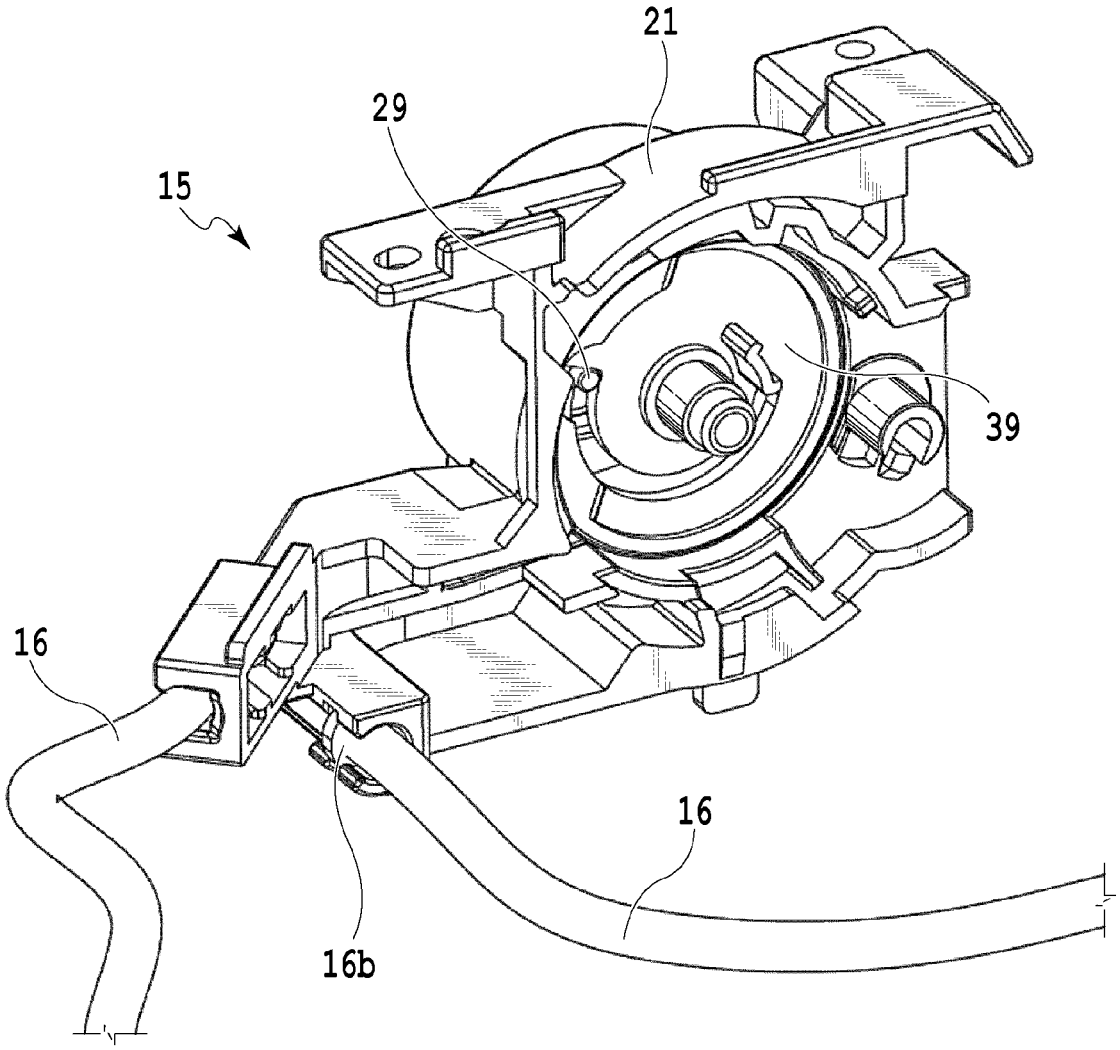
FIG. 11 is a perspective view showing a suction pump in a waste ink discharging mechanism.
Figure 12:
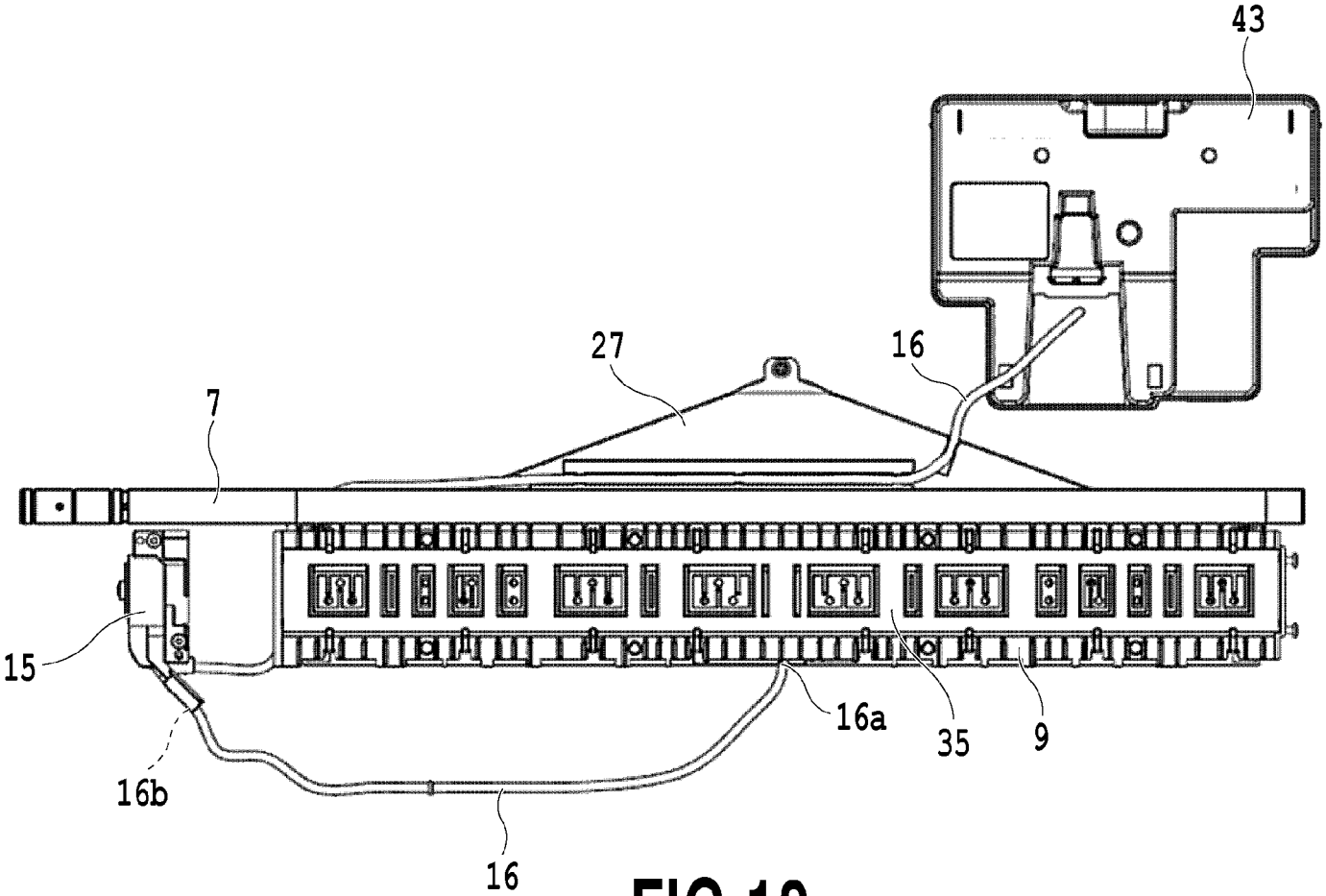
FIG. 12 is a plan view showing a waste ink recovery route in the waste ink discharging mechanism.

FIG. 11 is a perspective view showing a tube pump disposed in a waste ink discharging mechanism, and FIG. 12 is a plan view showing a waste ink recovery route.

The waste ink discharging mechanism includes a tube 16 connected to a waste ink discharge port 30 (see FIG. 8), a waste ink tank 43 connected to the tube 16, and a waste ink pump 15 disposed on the way of the tube 16.

The tube pump 15 is adapted to suck waste ink by squeezing the tube 16 while a roller 29 presses the tube 16 against the inner diameter surface of a pump case 21. The roller 29 is rotatably held by a roller holder 39 that is rotated. The roller holder 39 is connected to a pump drive motor 107 (see FIG. 13) serving as a drive source via a gear train, not shown, and is rotated in association with the rotation of the pump drive motor 107.

Moreover, a suction port 16*a* formed at one end of the tube 16 is connected to the waste ink discharge port (see FIG. 8) formed on the outer peripheral wall 20 of the platen 9. A discharge port 16*b* formed at the other end of the tube 16 is connected to the waste ink tank 43 (i.e., a waste ink reservoir) that eventually reserves the waste ink.

Upon the drive of the tube pump 15 in association with the drive of the pump drive motor 107, the waste ink collected in the downstream waste ink collector 31*g*1 at the platen 9 is discharged to the waste ink tank 43 through the waste ink discharge port 30 and the tube 16.

It is desirable that the waste ink collected in the downstream waste ink collector 31*g*1 at the platen 9 should be discharged at a timing at which the printing apparatus 1 is turned off or a quantity of ink ejected to the ink absorber 35 exceeds a predetermined threshold.

Figure 20:
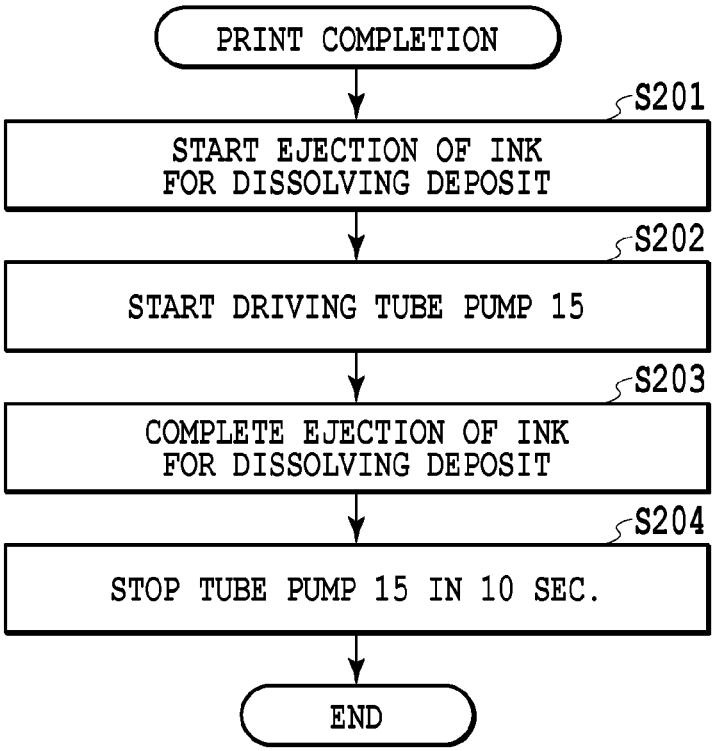
FIG. 20 is a flowchart illustrating a tube pump drive sequence.

In an ink deposition preventing operation for preventing a printing ink component from being deposited on the ink absorber 35, a special ink that easily dissolves a deposit may be ejected to the ink absorber 35 after the completion of a printing operation (see FIG. 20). According to the use environment of the printing apparatus 1, a relatively large quantity of ink is ejected to the ink absorber 35 so as to dissolve a deposit (S201). As a consequence, the ink stays on the ink absorber 35 immediately after the ink ejection, and therefore, the staying ink is liable to leak to the outside of the platen 9 through the gap defined by the platen 9 and the lock claw due to the capillary phenomenon. In view of this, during the ink deposition preventing operation, that is, during the ink ejection for dissolving the deposit, the tube pump 15 is driven in S202. Every time the ink is ejected onto the ink absorber 35, the ink can be induced into the ink absorber 35, thus preventing the ink from staying on the ink absorber 35. Also after the ink deposition preventing operation for dissolving the deposit (S203), the tube pump 15 is continuously driven for a predetermined period of time (e.g., 10 seconds) (S202 to S204), thus enhancing an effect for preventing the ink from staying on the ink absorber 35. The ink does not stay on the ink absorber 35 until the ink sufficiently reaches the entire ink absorber 35. Therefore, the drive control of the tube pump 15 during the ink ejection for the purpose of the dissolution of the deposit may be started after a lapse of a predetermined period of time since the use of the printing apparatus 1 is started. Incidentally, the above-described drive control of the tube pump 15 is performed by a CPU 101 (see FIG. 13) in a control system, described later.

In this manner, it is possible to suppress any overflow of the waste ink to the outside of the platen 9 from the waste ink collector 31*g*1 at the platen 9 or drying or adhesion of the waste ink at the waste ink channels 31*f*1 and 31*f*2 or the waste ink collector 31*g*1.

As shown in FIG. 12, the waste ink tank 43 is disposed in such as manner as not to overlap the platen 9, as the apparatus is viewed from the top. Specifically, the present embodiment does not adopt the configuration disclosed in Japanese Patent Laid-Open No. 2006-187903 in which the waste ink discarded on the platen is discharged right under the platen by utilizing gravity. The present embodiment is configured such that the waste ink is forcibly discharged to the waste ink tank 43 positioned outside of the platen 9 through the waste ink discharge port 30 formed at the side of the peripheral wall 20 of the platen 9 by the use of the tube 16 and the tube pump 15. As a consequence, the freedom degree of the arrangement of the waste ink tank 43 is increased. The waste ink tank 43 is installed at an empty space inside of the printing apparatus 1, thus avoiding an increase in size of the apparatus.

In addition, the duct 27 can occupy a space right under the platen 9, and therefore, a capacity enough to stabilize a negative pressure generated according to the rotation of the suction fan 19 can be secured inside of the duct 27. Furthermore, the duct 27 is disposed right under the platen 9, thus simplifying and shortening the intake channel 36 extending from the suction hole 18 to the suction fan 19, so as to reduce a channel resistance and save power consumption by the suction fan 19.

5. Control Circuit

Figure 13:
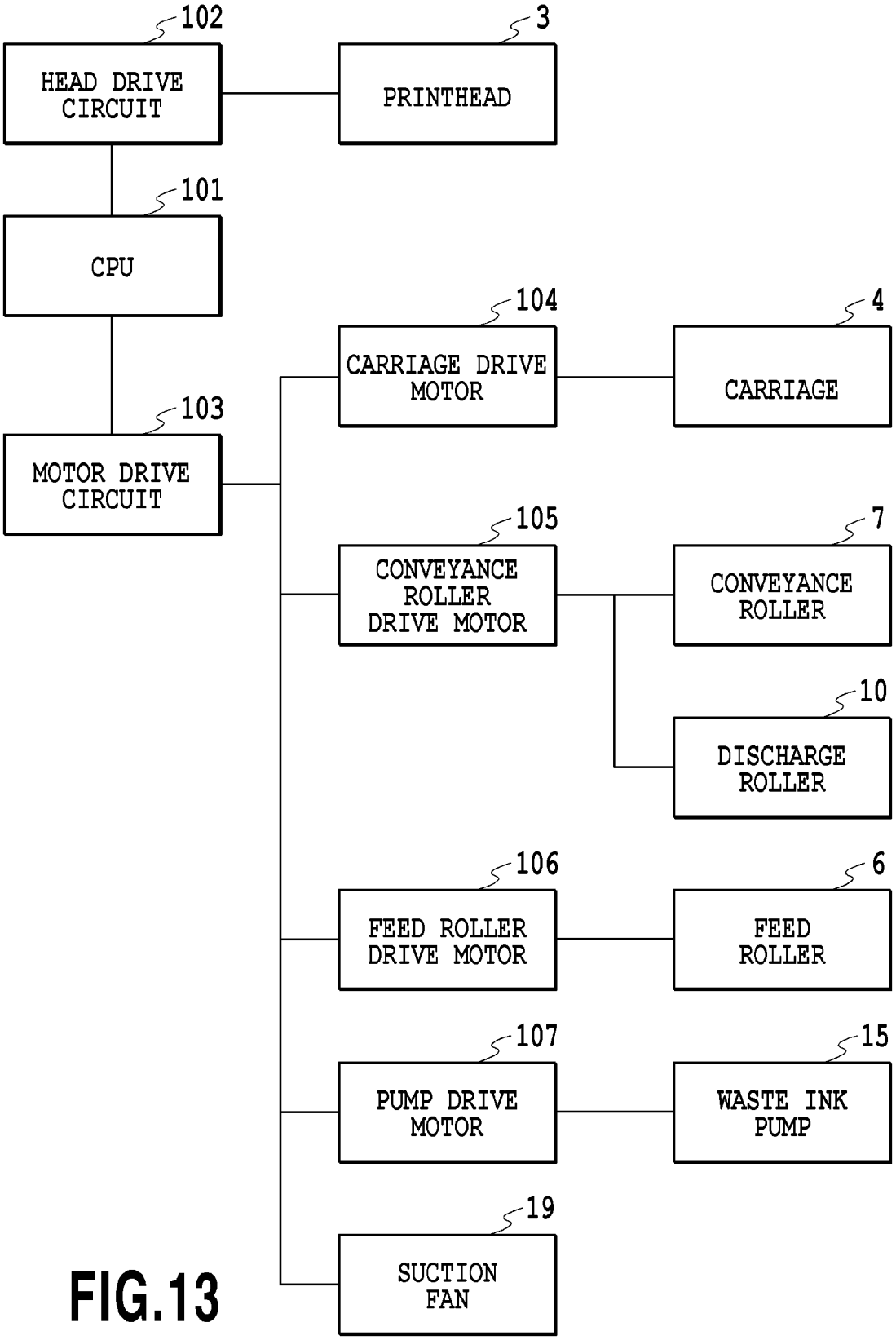
FIG. 13 is a block diagram illustrating the configuration of a control system in the printing apparatus.

FIG. 13 is a block diagram illustrating the configuration of a control system of the printing apparatus 1.

To the CPU 101 is connected a head drive circuit 102 for controlling the ink ejection of the printhead 3. Furthermore, to the CPU 101 is connected a motor drive circuit 103 for controlling motors for actuating the mechanisms (a carriage motor 104, a conveyance roller motor 105, a feed roller motor 106, the pump drive motor 107, the suction fan 19, etc.) and the like.

The motor drive circuit 103 can perform PWM control, thus adjusting the air rate of the suction fan 19 so as to adjust the suction negative pressure at the sheet sucking mechanism. A change in air rate according to the type of sheet, the state of a sheet, and an atmospheric environment condition is effective in adjusting sheet conveyance performance. The air rate may be changed according to the position of the carriage 4 and the sheet conveyance position.

6. Printing Operation

Figure 14:
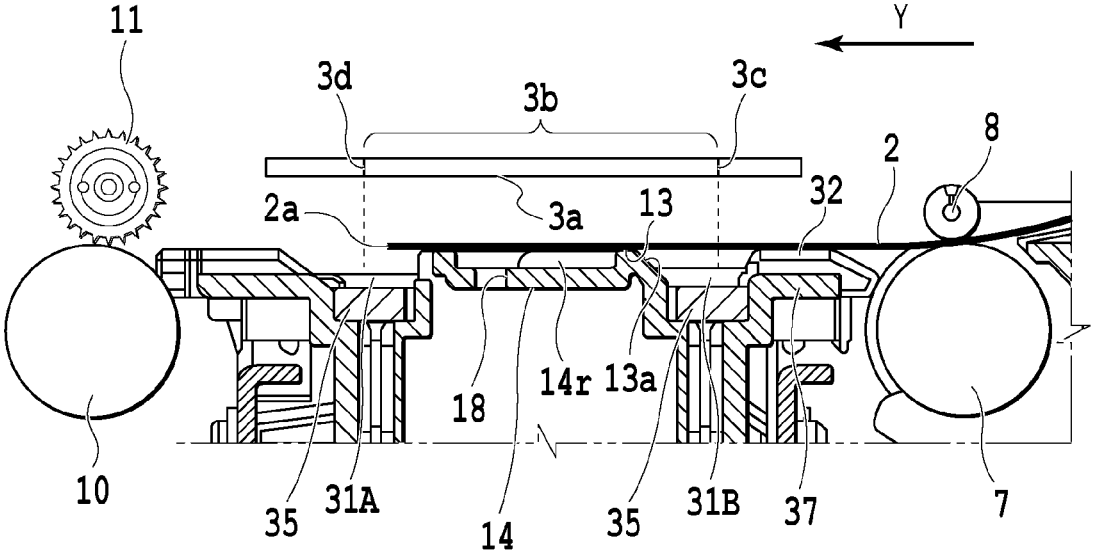
FIG. 14 is a vertical side view showing a printing operation.

Next, a description will be given of a printing operation in the printing apparatus 1. Upon transmitting a print command from a host computer or the like, not shown, to the printing apparatus 1, the CPU 101 performs the following operation. First, the suction fan 19 is driven in preparation for sucking and supporting the sheet 2 to be conveyed onto the platen 9. Subsequently, the feeder 40 is driven so that the sheet 2 is fed to the first conveyance roller pair consisting of the conveyance roller 7 and the pinch roller 8. The first conveyance roller pair conveys the sheet fed by the feeder 40 up to a position at which the sheet covers the sheet supporting surface 13, as shown in FIG. 14. During this conveying operation, the leading end 2*a* of the sheet 2 passes between the sheet supporting surface 13 and the printhead 3, and then, reaches a position above the leading end ink discarding groove 31A and upstream of a most downstream ejection port 3*d* at an ink ejection port array 3*b* in the Y direction.

Thereafter, the carriage 4 is started to be moved in the X direction, and furthermore, the ink is ejected from the printhead 3, thereby printing an image on the sheet 2. In a case where an image is formed over the entire sheet 2 without any margins at the ends of the sheet 2 by so-called marginless printing at this time, the ink is ejected to a region from the outside of the sheet 2 to the inside thereof. Here, even if the ink is ejected through all of the ejection ports at the ejection port array 3*b*, the most downstream ejection port 3*d* is located upstream of the leading end ink discarding groove 31A, and therefore, all the ink ejected to the outside (downstream) of the sheet 2 is received in the ink absorber 35. In addition, the right and left side ends of the sheet 2 are positioned above the right/left end ink discarding grooves 34 formed between the sheet supporting portions 14, so that all the ink ejected to the outside of the sheet 2 is received in the ink absorber 35. Consequently, the ink supporting surface 13 of the platen 9 is not smeared with the ink.

At this time, the rotation of the suction fan 19 allows air staying in the suction recess 17 formed at the sheet supporting portion 14 to be discharged through the second negative pressure chamber 25 of the duct 27, the first negative pressure chamber 22 of the platen 9, and the suction holes 18 of the platen 9. As a consequence, a negative pressure is generated in a space from the suction fan 19 to the reverse of the sheet 2. The negative pressure sucks the sheet 2 to the sheet supporting surface 13, and therefore, suppresses floating of the sheet 2 from the sheet supporting surface 13 or flexure of the sheet 2. In this manner, it is possible to keep a constant distance between the ejection port forming surface 3*a* of the printhead 3 and the sheet 2. In this state, the printing operation proceeds with respect to the sheet 2 by repeating the ink ejection by the printhead 3 and the intermittent conveyance of the sheet 2.

Figure 15:
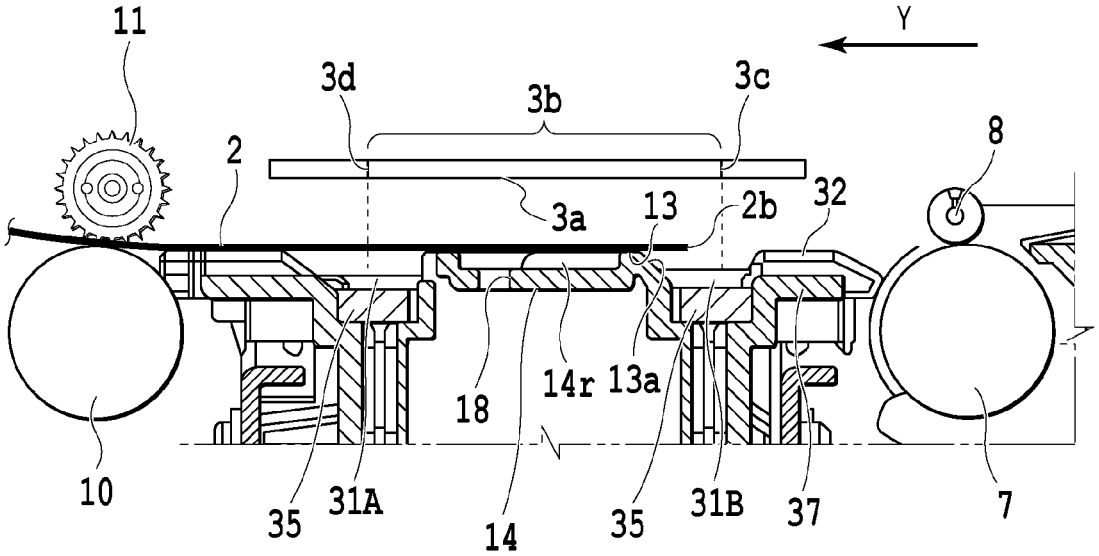
FIG. 15 is another vertical side view showing the printing operation.

Thereafter, the trailing end 2*b* of the sheet 2 passes the first conveyance roller pair, and then, reaches a position above the trailing end ink discarding groove 31B and downstream of a most upstream ejection port 3*c* in the Y direction, as shown in FIG. 15. In this state, a final printing operation is performed. At this time, all the ink ejected to the outside (i.e., upstream) of the sheet 2 is received by the ink absorber 35 even if all of the ejection ports at the ejection port array 3*b* are used, thus properly completing the marginless printing at the trailing end of the sheet 2. Thereafter, the rotation of the discharge roller 10 allows the sheet 2 to be discharged onto the discharge tray 12. Upon completion of the discharge of the sheet 2, the motor drive circuit 103 stops driving the suction fan 19.

In the meantime, even in the case of so-called border printing in which margins remain along the ends of the sheet 2, the sheet 2 covers the sheet supporting surface 13 all the time during the printing operation. Consequently, the sheet 2 is sucked to the sheet supporting surface 13 by the negative pressure generated at the suction recess 17 formed at the sheet supporting portion 14, thus suppressing floating of the sheet 2 from the sheet supporting surface 13 or flexure of the sheet 2. In this manner, even during the border printing operation, the printing operation can be properly performed while keeping the constant distance between the ejection port forming surface 3*a* of the printhead 3 and the sheet 2.

In the above-described embodiment, the four-side marginless printing can be performed with respect to a cut sheet. It is possible to properly perform the printing operation while the sheet sucking mechanism allows the stable negative pressure to act on the sheet, and furthermore, to recover the waste ink ejected onto the platen without increasing the size of the apparatus. In other words, the compact apparatus configuration can achieve the compatibility between the secure waste ink recovery and the certain sheet suction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107998 filed May 27, 2015, and No. 2015-164810 filed Aug. 24, 2015, which are hereby incorporated by reference herein in their entirety.

What is claimed is:

1. A printing apparatus comprising:

a printhead configured to eject ink;

a sheet conveying unit configured to convey a sheet in a first direction;

a suction unit configured to suction ink; and a platen unit configured to support the sheet to be printed with the printhead, wherein the platen unit comprises:

supporting portions arranged in a second direction intersecting with the first direction, and configured to support the sheet;

an ink receiver for receiving ink ejected from the printhead, the ink receiver being adjacent to the supporting portions in the first direction and extending in the second direction;

an ink channel including an inclined bottom surface for allowing flow of ink received by the ink receiver, the ink channel being disposed below the ink receiver and extending in the second direction;

an ink collector which can contain the ink flowing from the inclined bottom surface and is disposed below the inclined bottom surface; and a discharge port for discharging ink contained in the ink collector by suction of the suction unit through a tube connected to the discharge port.

2. The printing apparatus according to claim 1, wherein a negative pressure chamber configured to apply a negative pressure to a suction hole formed at the supporting portions is disposed under the supporting portions.

3. The printing apparatus according to claim 1, wherein the supporting portions, the ink receiver, the ink collector and the ink channel are aggregated into a single resin-molded component part.

4. The printing apparatus according to claim 1, further comprising a tank for storing ink suctioned by the suction unit, the tank being connected to the tube.

5. The printing apparatus according to claim 1, wherein the ink receiver includes a first ink receiver disposed upstream of the supporting portions with respect to the first direction, and a second ink receiver disposed downstream of the supporting portions with respect to the first direction.

6. The printing apparatus according to claim 5, further comprising:

a first ink channel disposed below the first ink receiver;

a second ink channel disposed below the second ink receiver; and a third ink channel for connecting the first ink channel to the second ink channel, wherein the ink collector is disposed at a bottom of the second ink channel, and the third ink channel is inclined to guide ink flowing in the first ink channel to the ink collector.

7. The printing apparatus according to claim 5, further comprising:

an upstream supporting portion for supporting the sheet upstream of the first ink receiver; and a downstream supporting portion for supporting the sheet downstream of the first ink receiver.

8. The printing apparatus according to claim 6, wherein at the bottom surface of at least one of the first ink channel, the second ink channel, and the third ink channel, concave-convex portions extending along the inclination of the bottom surface are formed.

9. The printing apparatus according to claim 1, further comprising:

an ink absorber for receiving ink ejected from the printhead, the ink absorber being disposed in the ink receiver, wherein the ink received in the ink absorber drops into the ink channel.

10. The printing apparatus according to claim 9, wherein a plurality of lock members configured to lock the ink absorber onto the ink receiver are formed at the platen unit.

11. The printing apparatus according to claim 10, wherein a sealant or a water repellent is applied between the platen unit and the lock members.

12. The printing apparatus according to claim 9, wherein an ink deposition preventing operation is performed so as to eject ink from the printhead onto the ink absorber upon completion of a printing operation in order to prevent an ink component from being deposited on the ink absorber.

13. The printing apparatus according to claim 1, wherein a plurality of supporting portions are disposed near an end of the sheet conveyed by the sheet conveying unit with respect to the second direction, and a right/left end ink receiver extending in the first direction is disposed between adjacent supporting portions.

14. A platen unit for supporting a sheet to be printed with a printhead, comprising:

supporting portions arranged in a sheet widthwise direction, and configured to support the sheet;

an ink receiver for receiving ink ejected from the printhead, the ink receiver being adjacent to the supporting portions in a second direction crossing the sheet widthwise direction, the ink receiver extending in the sheet widthwise direction;

an ink channel including an inclined bottom surface for allowing flow of ink received by the ink receiver, the ink channel being disposed below the ink receiver and extending in the second direction;

an ink collector which can contain the ink flowing from the inclined bottom surface, the ink collector being disposed below the inclined bottom surface; and a discharge port for discharging ink contained in the ink collector through a tube connected to the discharge port.

15. The platen unit according to claim 14, wherein the ink receiver includes a first ink receiver disposed upstream of the supporting portions with respect to the sheet widthwise direction and a second ink receiver disposed downstream of the supporting portions with respect to the sheet widthwise direction.

16. The platen unit according to claim 15, further comprising:

a first ink channel disposed below the first ink receiver;

a second ink channel disposed below the second ink receiver; and a third ink channel for connecting the first ink channel to the second ink channel, wherein the ink collector is disposed at a bottom of the second ink channel, and the third ink channel is inclined to guide ink flowing in the first ink channel to the ink collector.

* * * * *